US005842458A

United States Patent [19]

Alstrin et al.

[11] Patent Number: 5,842,458

[45] Date of Patent: Dec. 1, 1998

[54] SPARK PLUG BOOT WITH VENTABLE SEAL

[75] Inventors: Michael W. Alstrin, Indianapolis; Daniel L. Morin, North Vernon; C. Edward Morris, Columbus, all of Ind.

[73] Assignee: Cummins Engine Company, Inc., Columbus, Ind.

[21] Appl. No.: 909,631

[22] Filed: Aug. 12, 1997

[51] Int. Cl.[6] ..... F02P 11/00

[52] U.S. Cl. ..... 123/635; 123/169 PA

[58] Field of Search ..... 123/635, 169 PA, 123/169 R, 143 C, 198 E, DIG. 8, 169 C, 143 R; 439/126, 127, 336

[56] References Cited

U.S. PATENT DOCUMENTS

| | | | |
|---|---|---|---|
| 2,633,808 | 4/1953 | Webber | 123/169 R |
| 2,919,167 | 12/1959 | Taylor | 123/169 R |
| 3,057,408 | 10/1962 | Griffitts | 123/169 R |
| 4,768,477 | 9/1988 | Richardson | 123/169 R |
| 4,947,809 | 8/1990 | Hocking | 123/169 PA |
| 5,003,958 | 4/1991 | Yoneyama et al. | 123/635 |
| 5,060,624 | 10/1991 | Bruning et al. | 123/635 |
| 5,163,838 | 11/1992 | Tura, Jr. et al. | 439/126 |
| 5,170,767 | 12/1992 | Wada et al. | 123/633 |
| 5,237,982 | 8/1993 | Asakura et al. | 123/635 |
| 5,382,170 | 1/1995 | Imanishi | 439/127 |
| 5,537,983 | 7/1996 | Nakajima | 123/635 |
| 5,655,491 | 8/1997 | Nishiyama | 123/169 PA |

*Primary Examiner*—Raymond A. Nelli

*Attorney, Agent, or Firm*—Sixbey, Friedman, Leedom & Ferguson; Charles M. Leedom, Jr.; Tim L. Brackett, Jr.

[57] ABSTRACT

An improved sealing boot for a spark plug assembly is provided which includes a sealing and venting feature capable of preventing pressurized contaminants from reaching the spark plug by effectively sealing the spark plug mounting bore while permitting pressurized gas accumulating in the plug well to be vented to the engine overhead. The sealing and venting feature includes at least one annular sealing rib formed on the outer surface of the boot. The radial length and width of the sealing rib, and the resiliency of the material forming the rib, are selected to cause the rib to deflected outwardly an optimal degree, when the assembly is positioned in the bore, and to engage the bore wall with a sealing force so as to permit the desired sealing and venting. The optimal deflection causes the creation of an additional sealing force due to the pressure of fluid against the deflected portion of the rib thereby ensuring sealing.

18 Claims, 3 Drawing Sheets

SPARK PLUG BOOT WITH VENTABLE SEAL

TECHNICAL FIELD

The present invention relates to a sealing boot for a spark plug used in spark-ignited internal combustion engines which functions to prevent water intrusion into a plug bore formed in the engine while permitting venting of pressurized gas from the bore.

BACKGROUND OF THE INVENTION

Many internal combustion engines utilize a spark plug to initiate combustion. The spark plugs are typically secured in the inner end of a mounting bore formed in a portion of the engine, e.g. the cylinder head. An ignitor coil assembly is mounted at the outer end of the bore and extends into the bore to connect to the spark plug. In such plug arrangements, it is very important to prevent contaminants, such as water, from the environment from entering the lower portion of the bore adjacent the plug, i.e. plug well, and impairing the operation of the assembly, such as by disrupting the electrical performance of the plug or plug/coil connection. Also, it has been found that the plug well becomes pressurized with gas due to, for example, heating of well gas during engine operation and/or combustion gas leakage into the well.

U.S. Pat. No. 5,382,170 to Imanishi discloses a coupling for a high-voltage terminal of an ignition coil that includes a cylindrical insulator made of rubber which extends through a spark plug well to connect with a spark plug. The insulator is sealed against the spark plug well wall by a projection formed on the peripheral surface of the insulator and positioned axially between the plug and the coil. The reference also discloses a conventional spark plug assembly which appears to include a sleeve with a plurality of annular seals which seal on the upper portion of the spark plug well wall. However, the projection on the insulator and the plurality of annular seals are shaped to necessarily move away from the well wall when subjected to pressurized fluid on the coil side of the seals to thereby disadvantageously permit pressurized contaminant fluid into the well adjacent the plug. This flow of fluid contaminant may undesirably impair the electrical functioning of the assembly. In addition, this design does not permit venting of pressurized gases forming in the well around the plug due to, for example, heating of well gas during engine operation or combustion gas leakage into the well.

U.S. Pat. No. 5,170,767 to Wada et al. discloses an ignition coil for an internal combustion engine including an insulating resin member surrounding a conductor for insertion into a spark plug hole formed in an engine for connection to a spark plug. The insulating resin member appears to include a pair of integrally molded rings on its outer periphery (FIG. 8). However, this reference does not suggest that the radial rings are shaped and could be positioned to form a liquid tight seal against the spark plug well while also allowing pressurized gases to be vented from the spark plug well.

U.S. Pat. No. 2,633,808 to Webber discloses a well swab with a plurality of sealing rings that support some predetermined fluid pressure when the swab is raised thereby sealing fluid, below the predetermined fluid pressure, from passing by the first seal. The reference further discloses that the sealing rings readily flex upwardly to permit fluid to pass exteriorly between the sealing rings and the bore wall. However, the sealing rings are specifically designed to move downwardly, in response to a predetermined pressure, out of contact with the bore wall to permit fluid flow into the bore. In addition, the sealing rings do not permit venting of the bore below the rings while also preventing reverse flow. Also, this device no where suggests the use of sealing rings for a spark plug assembly of an internal combustion engine.

Consequently, there is a need for an improved ignition and spark plug assembly including a boot capable of preventing contaminants from entering the spark plug well area in a mounting bore while also permitting venting of pressurized gases in the well area.

SUMMARY OF THE INVENTION

Therefore, it is one object of the present invention to provide an improved sealing boot for a spark plug assembly which overcomes the disadvantages of the prior art.

Another object of the present invention is to provide a sealing boot which permits an ignitor to be easily connected to a spark plug mounted in a mounting bore formed in an engine while effectively sealing the plug from exposure to contaminants.

Yet another object of the present invention is to provide a sealing boot which minizes the likelihood of damage to a spark plug and ignitor due to excessive installation force, overpressurization of the spark plug well and leakage of contaminants into the well.

A further object of the present invention is to provide a sealing boot for a spark plug assembly which effectively prevents pressurized fluid from reaching the plug mounted on an engine during engine manufacture.

Another object of the present invention is to provide a sealing boot for a spark plug which effectively prevents overpressurization of the spark plug well.

Yet another object of the present invention is to provide a sealing boot for a spark plug which effectively vents gases from the spark plug well.

Still another object of the present invention is to provide a simple, inexpensive sealing boot for a spark plug assembly which effectively seals the plug mounting bore to prevent contaminants from reaching the plug well while also functioning to vent the well.

Yet another object of the present invention is to provide a simple, inexpensive sealing boot which effectively seals the mounting bore while minimizing the axial installation force required to create the seal.

These and other objects are achieved by providing a sealing boot for a spark plug assembly positionable in a plug mounting bore formed in a cylinder head of an internal combustion engine, comprising a boot body including an outer surface positionable adjacent an inner surface of the mounting bore when the boot is positioned in the mounting bore. The boot body also includes an inner cavity for engagingly receiving a portion of the spark plug assembly. The sealing boot also includes at least one annular sealing rib extending radially outwardly from the outer surface of the boot body for engaging the inner surface of the mounting bore to form a seal joint. The annular sealing rib is formed of a flexible, resilient material and includes a sealing and venting feature for preventing passage of contaminants through the seal joint in a first direction axially along the mounting bore while permitting venting of gas through the joint in a second direction opposite the first direction. The sealing and venting feature includes a radial length and a width of the annular sealing rib which both have a predetermined size for causing the sealing rib to deflect toward the second position when installed in the mounting bore. The predetermined size of the radial length and width also enable the sealing rib to be biased into sealed abutment by pressure forces of contaminants acting on the sealing rib in the first direction. The at least one sealing rib may include a first set of sealing ribs and this first set may be in the form of a pair of sealing ribs. A first guide rib may be positioned adjacent the first set of sealing ribs for guiding the boot along the mounting bore during insertion into the mounting bore. The first guide rib includes a diametrical outer extent less than the outer extent of the mounting bore. The at least one sealing rib may also include a second set of sealing ribs, and the second set may be in the form of a pair of sealing ribs. Also, a second guide rib may be provided adjacent the second set of sealing ribs. The boot body may further include a cylindrical extension positioned in the inner cavity for engaging a spark plug and an annular recess formed radially between the cylindrical extension and the outer surface of the boot body for receiving an ignitor body.

The present invention also provides an ignitor assembly positionable in a spark plug mounting bore formed in a cylinder head of an internal combustion engine for connection to a spark plug. The ignitor assembly includes an ignitor body including a first end portion and a second end portion, an ignitor coil mounted on the first end portion of the ignitor body and the sealing boot of the present invention mounted on the second end portion of the ignitor body.

DETAILED DESCRIPTION OF THE PREFERRED EMBODIMENT

Figure 1:
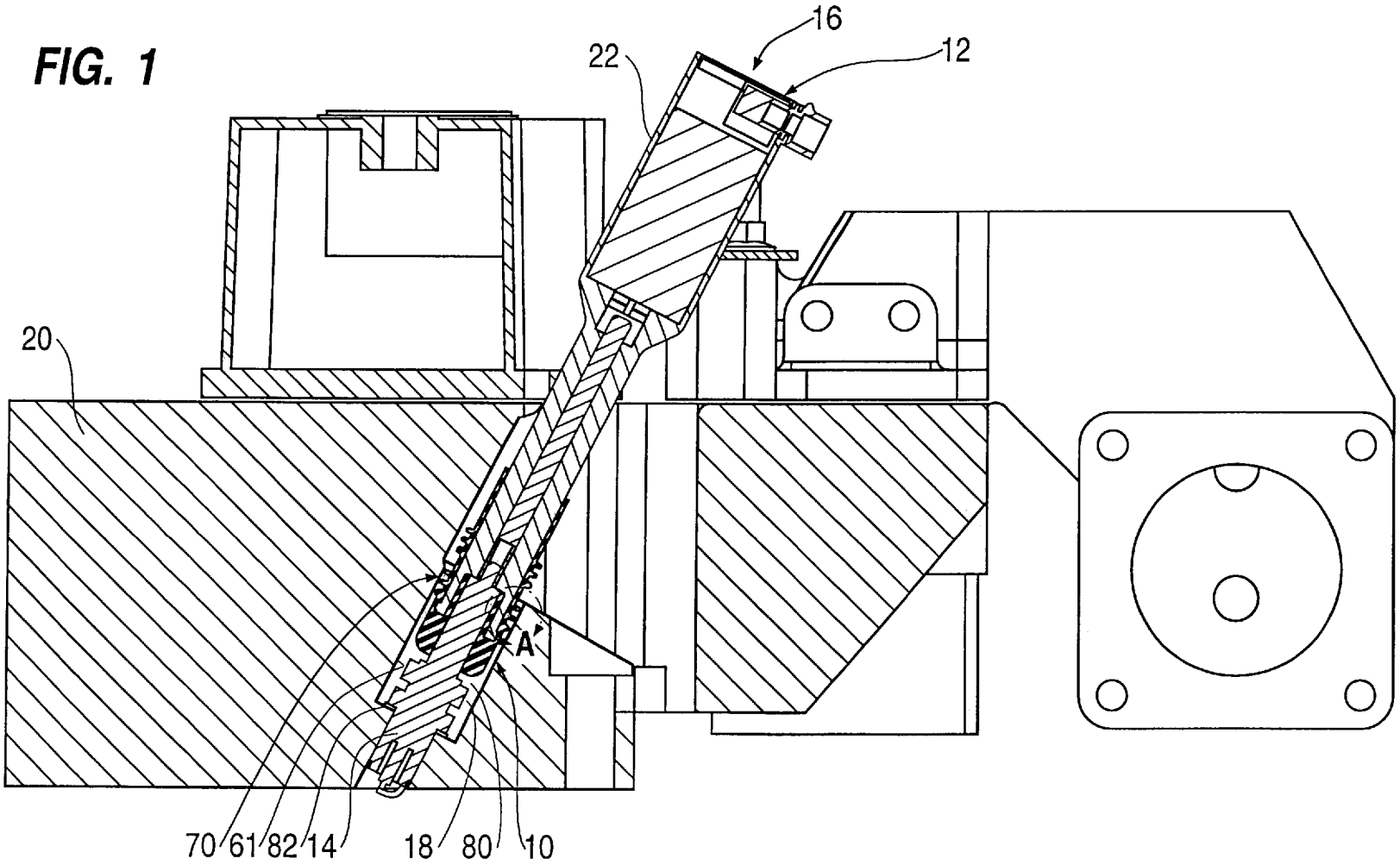
FIG. 1 is a partial cross sectional side view of the spark plug assembly of the present invention and an engine cylinder head showing the sealing boot of the present invention mounted on an ignitor assembly and spark plug and positioned in a spark plug mounting bore formed in the cylinder head.

Referring to FIG. 1, the sealing boot of the present invention, indicated generally at 10, is shown mounted on an ignitor 12 and connected to a spark plug 14 to form a spark plug assembly 16 positioned in a spark plug mounting bore 18 formed in a cylinder head 20 of an internal combustion engine. Sealing boot 10 functions to advantageously prevent contaminants from entering the lower portion of the spark plug mounting bore, i.e. plug well, adjacent the spark plug 18 while also permitting venting of pressurized gases from the plug well thereby minimizing the damage to spark plug assembly 16 and the associated electrical connection.

Figure 2:
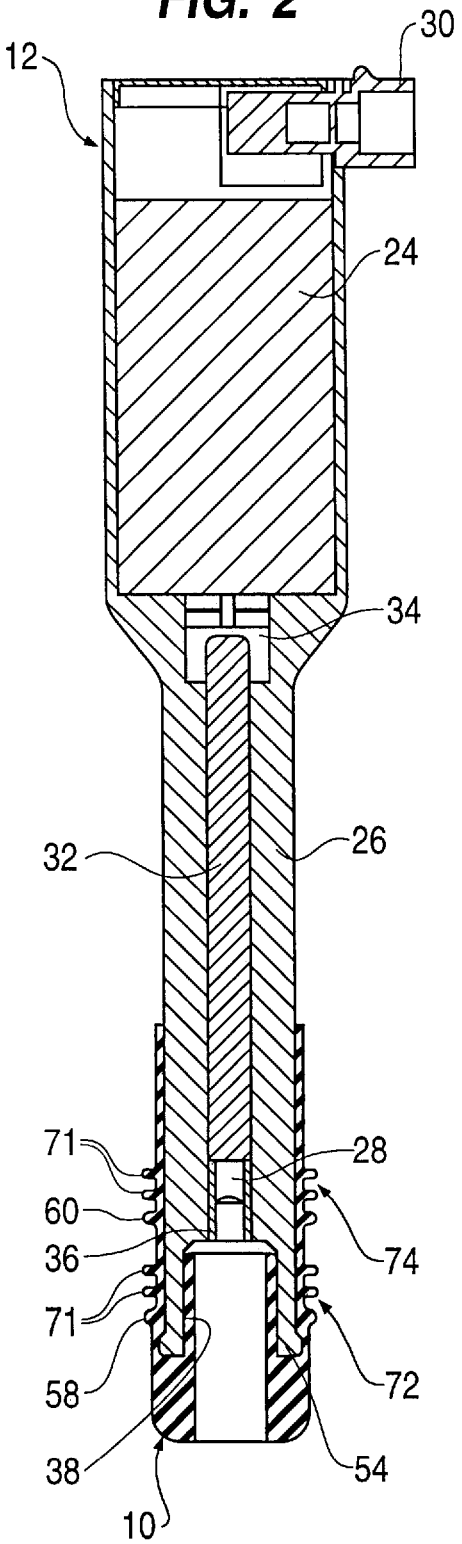
FIG. 2 is a cross sectional view of the ignitor assembly of the present invention including the present sealing boot.

Referring to FIGS. 1 and 2, the ignitor 12 includes an ignitor body 22 having an outer portion housing a coil assembly 24 and an elongated inner portion 26 including a central bore 28. Coil assembly 24 may be any conventional coil assembly capable of generating a voltage of sufficient magnitude for allowing spark plug 14 to create a desired discharge for igniting a fuel mixture in the combustion chamber of the engine (not shown). The outer portion of ignitor 12 also includes an electrical connection 30 for connecting coil assembly 24 to an electrical source. Ignitor body 22 is formed of an insulating material while a rod-like electrical conductor 32 is positioned in central bore 28 of inner portion 26. The outer end of electrical conductor 32 is connected to the output of coil assembly 24 in a conventional manner at a high voltage connection indicated at 34. The inner end of electrical conductor 32 includes a tubular element 36 extending to the end of central bore 28. A recess 38 is provided in the inner end of inner portion 26 for receiving spark plug 14. When ignitor body 22 is pushed into spark plug mounting bore 18, the outer end of spark plug 14 contacts tubular element 36 to form an electrical connection between electrical conductor 32 and spark plug 14 as shown in FIG. 1.

Figure 3:
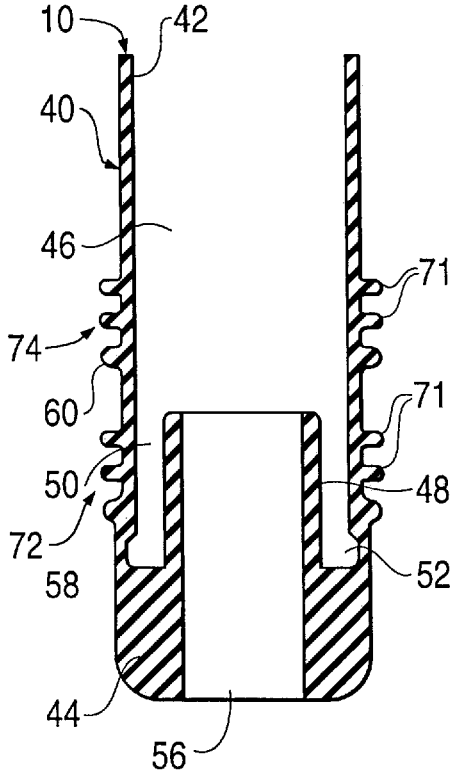
FIG. 3 is a cross sectional view of the sealing boot of the present invention.
Figure 4:
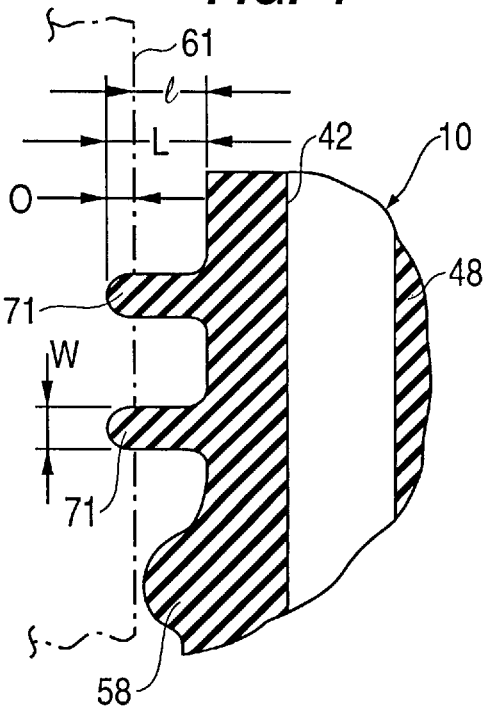
FIG. 4 is an expanded partial cross-sectional view of the sealing ribs of the boot of the present invention.

Referring to FIGS. 2 and 3, sealing boot 10 includes a boot body 40 including an outer cylindrical portion 42 integrally formed on, and extending from, a base portion 44. Boot body 40 is preferably formed of a flexible, resilient material, such as silicon rubber, to permit secure mounting on ignitor body 22 and spark plug 14 while ensuring the sealing and venting functions of sealing boot 10 as described more fully hereinbelow. Outer cylindrical portion 42 forms an inner cavity 46 sized to receive, and form an interference fit with, inner portion 26 of ignitor body 22. Boot body 40 also includes a cylindrical extension 48 extending outwardly from base portion 44 into inner cavity 46. An annular recess 50 is formed between cylindrical extension 48 and the inner portion of outer cylindrical portion 42. Annular recess 50 includes an annular groove 52 for receiving an annular land 54 formed on the end of inner portion 26 of ignitor body 22. Cylindrical extension 48 forms a central bore 56 which extends through base portion 44 and is sized to engagingly receive spark plug 14. Sealing boot 10 also includes first and second annular guide ribs 58, 60 formed integrally on the outer surface of boot body 40. The outer diametrical extent of first and second annular guide ribs 58, 60 is less than the outer extent/diameter of spark plug mounting bore 18 to create a clearance between guide ribs 58, 60 and an inner surface 61 of cylinder head 20 forming mounting bore 18 when spark plug assembly 16 is mounted in bore 18 as shown in FIG. 4. First and second annular guide ribs 58, 60 are preferably integrally formed on boot body 40 and therefore formed of the same flexible, resilient material as boot body 40. Ribs 58, 60 function to guide ignitor assembly 12, including sealing boot 10 into spark plug mounting bore 18.

Sealing boot 10 also includes a sealing and venting feature, indicated generally at 70, for creating an impervious seal between boot body 40 and the inner surface of cylinder head 20 forming spark plug mounting bore 18 while also permitting the venting of pressurized gases from a spark plug well section 80 formed in the inner portion of spark plug mounting bore 18. Sealing and venting device 70 includes at least one annular sealing rib extending around cylindrical portion 42. As shown in FIGS. 2 and 3, in the present embodiment, a first set of annular sealing ribs 72 is provided adjacent first annular guide rib 58 and a second set of annular sealing ribs 74 is provided adjacent second annular guide rib 60. It should be noted that the first set of sealing ribs 72 is utilized in the application of FIG. 1 to provide a sealing and venting function while the second set is not directly used. The second set of sealing ribs 74 is provided to permit the use of the same sealing boot 10 in other applications wherein only an outer portion of spark plug mounting bore 18 is sized to engage the second set of ribs 74 while an inner portion of spark plug mounting bore 18 is larger. By this design, sealing boots then can be used in a variety of applications. Of course, first and second sets of sealing ribs 72, 74 could both be used to provide sealing and venting redundancy.

Figure 5:
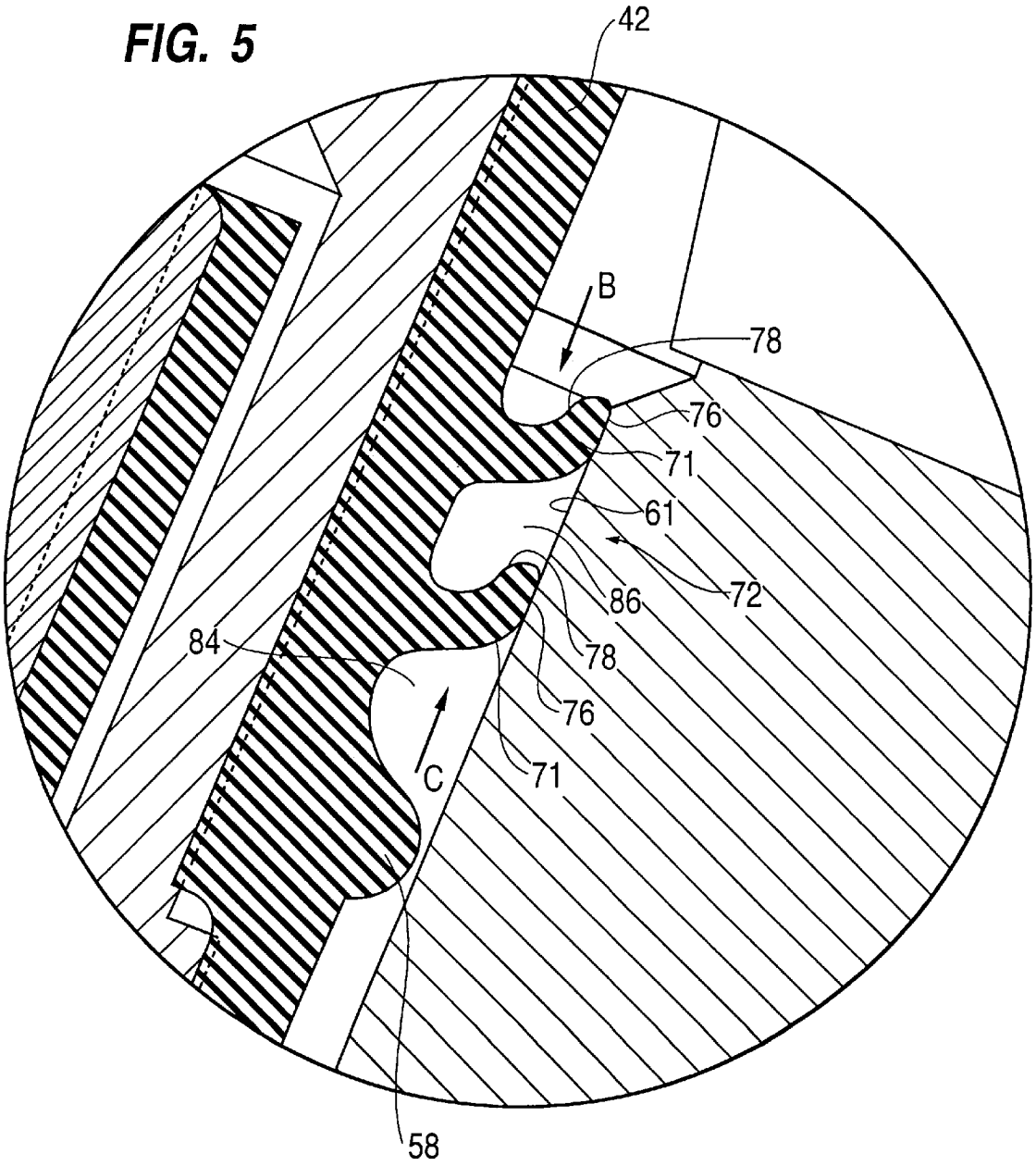
FIG. 5 is an expanded view of the area A of FIG. 1.

First and second sets of annular sealing ribs 72, 74 each include a pair of ribs preferably integrally formed on the outer surface of boot body 40 and, therefore, formed of the same flexible, resilient material as boot body 40. Each annular sealing rib 71 is designed with a radial length L and a width W of predetermined sizes, and of a material having a predetermined stiffness, which enable each rib 71 to deflect outwardly into an optimal sealing position against inner surface 61 of mounting bore 18 with an optimum sealing force when ignitor assembly 12, including sealing boot 10, is pushed into mounting bore 18, as shown in FIG. 5. The deflected position of each annular sealing rib 71 forms a respective seal joint 76 formed by the abutment of rib 71 against inner surface 61. Referring to FIG. 4, the total radial length L, relative to the outer extent of mounting bore 18, i.e. diameter, determines the amount of overlap O between the rib and the inner surface 61. The magnitude of overlap O primarily determines the abutment surface area of seal joint 76 and also impacts the resistance to deflection. All other dimensions constant, the greater the overlap O, the greater the sealing force at seal joint 76 and the greater the resistance to deflection. The total radial length L also includes a partial length l extending from the base of rib 71 to inner surface 61 of bore 18. The partial length 1 also affects the resistance of the rib to deflection when exposed to pressure forces. As the partial length l is increased, the resistance of rib 71 to deflection is decreased and vice versa. The width W primarily affects the resistance to deflection and therefore the sealing force of rib 71 against the inner wall of mounting bore 18. Increasing the width W, increases the resistance to deflection of rib 71, resulting in a greater reaction force by rib 71 against inner surface 61 of plug mounting bore 18 resulting in a tighter seal at seal joint 76. Thus, each rib 71 can be designed with an optimum total length L, including an overlap O and partial length l, a width W, and formed of a material having a predetermined stiffness, which cause the rib 71 to be biased into sealed abutment with inner surface 61 with an optimum sealing force and resistance to deflection to prevent contaminants from entering well section 80.

Moreover, pressurized fluid or gas directed into mounting bore 18 in the direction of arrow B as shown in FIG. 5 will tend to increase the sealing pressure at seal joint 76 by acting on rib 71. This sealing effect is achieved by forming rib 71 to create an overlap O of a sufficient size to permit rib 71 to extend or deflect outwardly so that when the rib is in the deflected position as shown in FIG. 5, an inner surface 78 of rib 71 is positioned relative to, i.e. extend along, inner surface 61 so that fluid pressure forces acting on surface 78 will tend to bias rib 71 into sealing abutment with the inner wall of mounting bore 18. As a result, the pressure of the contaminant fluids attempting to enter mounting bore 18 will act on surface 78 of ribs 71 to increase the sealing force at seal joint 76. This additional fluid pressure induced sealing force can be varied by varying the radial length L of rib 71 so as to vary the surface area of surface 78.

Another important aspect of sealing and venting device 70 is the ability of ribs 71 to permit pressurized gases in spark plug well section 80 of mounting bore 18, to be vented via seal joint 76 without sacrificing the ability of seal joint 76 to effectively prevent fluids from entering well section 80. Therefore, total radial length L including overlap O and partial 1, width W and the material for ribs 71, are selected to not only provide optimum sealing at seal joint 76 but also permit continued outward deflection of ribs 71 under the pressure of gases acting in the direction of arrow C as shown in FIG. 5. Pressurized gas develops in well section 80 due to thermal expansion of existing gas in mounting bore 18 and/or the inadvertent flow of combustion gas from the combustion chamber through a spark plug seal 82. Relief of the pressurized gas from well 80 prevents damage to ignitor assembly 12 and spark plug 14 while also preventing ignitor assembly 12 from being blown out of mounting bore 18 by the pressurized gas during operation or disassembly. Pressurized gas in well section 80 is also present in an annular groove 84 formed between annular guide rib 58 and the adjacent rib 71. The pressurized gas acts on the inner surface of sealing rib 71 tending to deflect rib 71 outwardly. When the pressure of the gas in groove 84 reaches a predetermined maximum limit, the pressure force acting on rib 71 will deflect rib 71 outwardly in the direction of arrow C in FIG. 5 lifting rib 71 from the inner wall forming mounting bore 18 thereby allowing the pressurized gas to flow through seal joint 76. This same pressurization and deflection may then occur in an annular groove 86 formed between ribs 71 of the first set of sealing ribs 72 causing the outer rib to deflect. In this manner, pressurized gases in well section 80 are vented into the engine overhead.

One embodiment of the present sealing boot, which created optimum sealing and venting while minimizing installation force, possessed the following dimensions. Each sealing rib 71 included a total radial length L of 2.25 mm, an overlap O of approximately 0.5 mm, a partial length l of 1.75 mm and a width W of 1 mm. The boot and ribs were formed of silicon rubber having a rating of ASTM D2000/SAE J200.

During assembly, the spark plug 14 is inserted into mounting bore 18 and threadably secured in position as shown in FIG. 1. Sealing boot 10 is then slid onto the end of inner portion 26 of ignitor body 22 as shown in FIG. 2. The ignitor assembly 12 including sealing boot 10 is then inserted into spark plug mounting bore 18 into full engagement on the outer end of spark plug 14 as shown in FIG. 1. During inward movement of sealing boot 10, ribs 71 engage the inner surface 61 of bore 18 and deflect outwardly into the position shown in FIG. 5.

The sealing boot 10 of the present invention results in various advantages over existing sealing boot designs. First, sealing boot 10 effectively seals the spark plug well thereby preventing contaminants present in the engine overhead from passing through mounting bore 18 into well section 80. As a result, sealing boot 10 prevents contaminants from impairing the electrical connection between spark plug 14 and ignitor assembly 12. For instance, during engine assembly, pressurized fluid is used to clean the engine. This pressurized washing fluid is often directed into the engine overhead and therefore flows into mounting bore 18. Without an effective sealing device, the pressurized washing fluid is pressurized at such a magnitude so as to overcome many conventional sealing arrangements. However, the sealing and venting device 70 of the present invention is capable of optimally resisting the flow of pressurized fluid. Second, sealing boot 10 is also capable of venting pressurized gas from well section 80 thereby effectively preventing over pressurization of the spark plug well. As a result, this device minimizes the likelihood of damage to the spark plug assembly 16 and prevents the ignitor assembly 12 from being blown out of the mounting bore 18 by pressurized gases in the well section 80 thus avoiding injury to personnel. Moreover, many conventional sealing boots include sealing rings which have a very short length and a relatively large width resulting in a large radial sealing force without deflection. These conventional sealed designs require an excessive amount of axial installation force to be applied to the ignitor assembly to move the boot through the mounting bore which complicates assembly and may cause damage to the ceramic portion of spark plug 14 upon connection with excessive installation force. The present sealing boot 10, however, significantly reduces the installation force required to position ignitor assembly 12 in mounting bore 18 due to the optimal deflection of ribs 71. Ribs 71 are designed with an optimal total radial length L including overlap O and partial length l, an optimal width W and formed of a material, selected so as to effectively seal mounting bore 18 while permitting venting of well section 80 and minimizing installation force. As a result, the present assembly minimizes the likelihood of damage to a spark plug and ignitor due to excessive installation force, over pressurization of the spark plug well and leakage of contaminants into the well.

INDUSTRIAL APPLICABILITY

The present sealing boot may be used in conjunction with any spark plug and ignitor assembly on any spark-ignited internal combustion engine of any vehicle or industrial equipment.

We claim:

1. A sealing boot for a spark plug assembly positionable in a plug mounting bore formed in a cylinder head of an internal combustion engine, comprising:

a boot body including an outer surface positionable adjacent an inner surface of the mounting bore when said sealing boot is positioned in the mounting bore, said boot body including an inner cavity for engagingly receiving a portion of the spark plug assembly; and at least one annular sealing rib extending radially outwardly from said outer surface of said boot body for engaging the inner surface of the mounting bore to form a seal joint, said annular sealing rib formed of a flexible, resilient material and including a sealing and venting means for preventing passage of contaminants through the seal joint in a first direction axially along the mounting bore while permitting venting of gas through the joint in a second direction opposite said first direction, said sealing and venting means including a radial length and a width of said annular sealing rib, said radial length and said width being of a predetermined size for causing said sealing rib to deflect toward said second direction when installed in the mounting bore and for causing said sealing rib to be biased into sealed abutment with the inner surface by pressure forces of contaminants acting on one side of said sealing rib.

2. The sealing boot of claim 1, wherein said at least one sealing rib includes a first set of sealing ribs.

3. The sealing boot of claim 2, wherein said first set of sealing ribs is a pair of sealing ribs.

4. The sealing boot of claim 2, further including a first guide rib positioned adjacent said first set of sealing ribs for guiding the boot along the mounting bore during insertion into the mounting bore, said first guide rib having a diametrical outer extent less than the outer extent of the mounting bore.

5. The sealing boot of claim 4, wherein said at least one sealing rib further includes a second set of sealing ribs, further including a second guide rib positioned adjacent said second set of sealing ribs.

6. The sealing boot of claim 5, wherein said second set of sealing ribs is a pair of sealing ribs.

7. The sealing boot of claim 1, wherein said boot body further includes a cylindrical extension positioned in said inner cavity for engaging a spark plug and an annular recess formed radially between said cylindrical extension and said outer surface of said boot body for receiving an ignitor body.

8. The sealing boot of claim 1, wherein said annular sealing rib is formed of rubber and the predetermined size of said radial length of said sealing rib is at least twice as large as the predetermined size of said width of said sealing rib.

9. The sealing boot of claim 1, wherein said radial length includes an overlap dimension defined by a radial distance by which the radial length of the sealing rib exceeds a diameter of the plug mounting bore, said overlap dimension functioning to determine an extent of the biasing effect on said sealing rib caused by pressure forces of contaminants causing said sealing rib to sealingly abut the inner surface of the mounting bore.

10. An ignitor assembly positionable in a spark plug mounting bore formed in a cylinder head of an internal combustion engine for connection to a spark plug, comprising:

an ignitor body including a first end portion and a second end portion;

an ignitor coil mounted on said first end portion of said ignitor body;

a sealing boot mounted on said second end portion of said ignitor body including a boot body having an outer surface positionable adjacent an inner surface of the mounting bore when said sealing boot is positioned in the mounting bore, said sealing boot further including at least one annular sealing rib extending radially outwardly from said outer surface of said boot body for engaging the inner surface of the mounting bore to form a seal joint, said annular sealing rib formed of a flexible, resilient material and including a sealing and venting means for preventing passage of contaminants through the seal joint in a first direction axially along the mounting bore while permitting venting of gas through the joint in a second direction opposite said first direction, said sealing and venting means including a radial length and a width of said annular sealing rib, said radial length and said width being of a predetermined size for causing said sealing rib to deflect toward said second direction when installed in the mounting bore, for causing said sealing rib to be biased into sealed abutment with the inner surface by pressure forces of contaminants acting on one side of said sealing rib and for causing said sealing rib to be moved away from said inner surface when gas pressure at a predetermined magnitude acts on an opposite side of said sealing rib.

11. The ignitor assembly of claim 8, wherein said at least one sealing rib includes a first set of sealing ribs.

12. The ignitor assembly of claim 11, wherein said first set of sealing ribs is a pair of sealing ribs.

13. The ignitor assembly of claim 11, further including a first guide rib positioned adjacent said first set of sealing ribs for guiding the boot along the mounting bore during insertion into the mounting bore, said first guide rib having a diametrical outer extent less than the outer extent of the mounting bore.

14. The ignitor assembly of claim 13, wherein said at least one sealing rib further includes a second set of sealing ribs, further including a second guide rib positioned adjacent said second set of sealing ribs.

15. The ignitor assembly of claim 14, wherein said second set of sealing ribs is a pair of two sealing ribs.

16. The ignitor assembly of claim 10, wherein said boot body further includes a cylindrical extension positioned in said cavity for engaging a spark plug and an annular recess formed radially between said cylindrical extension and said outer surface of said boot body for receiving an ignitor body.

17. The sealing boot of claim 10, wherein said annular sealing rib is formed of rubber and the predetermined size of said radial length of said sealing rib is at least twice as large as the predetermined size of said width of said sealing rib.

18. The sealing boot of claim 10, wherein said radial length includes an overlap dimension defined by a radial distance by which the radial length of the sealing rib exceeds a diameter of the plug mounting bore, said overlap dimension functioning to determine an extent of the biasing effect on said sealing rib caused by pressure forces of contaminants causing said sealing rib to sealingly abut the inner surface of the mounting bore.

* * * * *